United States Patent [19]

Kniseley et al.

[11] Patent Number: 4,897,282

[45] Date of Patent: Jan. 30, 1990

[54] THIN FILM COATING PROCESS USING AN INDUCTIVELY COUPLED PLASMA

[75] Inventors: Richard N. Kniseley; Frederick A. Schmidt; Brian D. Merkle, all of Ames, Iowa

[73] Assignee: Iowa State University Reserach Foundation, Inc., Ames, Iowa

[21] Appl. No.: 199,286

[22] Filed: Aug. 23, 1988

Related U.S. Application Data

[63] Continuation-in-part of Ser. No. 904,680, Sep. 8, 1986, abandoned.

[51] Int. Cl.[4] ..... B05D 3/06

[52] U.S. Cl. ..... 427/34

[58] Field of Search ..... 427/34, 423; 219/121.38, 121.49, 121.5

[56] References Cited

U.S. PATENT DOCUMENTS

| | | | |
|---|---|---|---|
| 2,292,869 | 1/1960 | Giannini et al. . | |
| 3,246,114 | 4/1966 | Matvay . | |
| 3,296,410 | 1/1967 | Hedger | 219/121 PR |
| 3,304,774 | 2/1967 | Poole | 219/121 PR |
| 3,324,334 | 6/1967 | Reed . | |
| 3,839,618 | 10/1974 | Muehlberge | 427/34 |
| 4,146,654 | 3/1979 | Guymnet | 427/34 |
| 4,328,257 | 5/1982 | Muehlberger . | |
| 4,501,965 | 2/1985 | Douglas . | |
| 4,604,306 | 8/1986 | Browning | 427/34 |

OTHER PUBLICATIONS

Barnes and Schleicher (1975), Spectrochimica Acta, 30B:109–134.

Dickinson and Fassel (1969), Analyt. Chem. 41:1021–1024.

Reed (1961), J. Appl. Phys., 32:2534–2535.

Hollabaugh et al., (1983), J. Materials Sci., 18:3190–3194.

Pertel (1975), Intern. J. Mass Spect. & Ion Phys., 16:39–52.

Fassel and Kniseley (1974), Anal. Chem. 46(13):1110A–1118A.

Fassel (1978), Science 202:183–191.

Douglas and Houk (1985), Prog. Analyt. Atom. Spectrosc., 8:1–8.

*Primary Examiner*—Norman Morgenstern

*Assistant Examiner*—Marianne L. Pudgett

*Attorney, Agent, or Firm*—Tilton, Fallon, Lungmus & Chestnut

[57] ABSTRACT

Thin coatings of normally solid materials are applied to target substrates using an inductively coupled plasma. Particles of the coating material are vaporized by plasma heating, and pass through an orifice to a first vacuum zone in which the particles are accelerated to a velocity greater than Mach 1. The shock wave generated in the first vacuum zone is intercepted by the tip of a skimmer cone that provides a second orifice. The particles pass through the second orifice into a second zone maintained at a higher vacuum and impinge on the target to form the coating. Ultrapure coatings can be formed.

10 Claims, 3 Drawing Sheets

THIN FILM COATING PROCESS USING AN INDUCTIVELY COUPLED PLASMA

ACKNOWLEDGMENT

Research leading to the present invention was carried out in the Ames Laboratory, U.S.D.O.E., at Iowa State University, Ames, Iowa. The Government has rights therein.

RELATED APPLICATION

This application is a continuation-in-part of copending application Ser. No. 904,680, filed Sept. 8, 1986 now abandoned.

FIELD OF INVENTION

This invention relates generally to the field of deposition technologies in which solid materials are produced from the vapor phase. More specifically, this invention relates to coatings formed from vaporized normally solid materials.

BACKGROUND OF INVENTION

Techniques for producing solid materials from the vapor phase are generally referred to as deposition technologies, which are distinguished from melting-/solidification technologies in which solid materials are produced from the liquid phase. The properties of solid materials produced from the vapor phase can be varied over a much wider range than the same materials produced from the liquid phase. Deposition technologies can be generally classified as: (1) physical vapor deposition, including evaporation, sputtering, and ion plating; (2) chemical vapor deposition; (3) ion implantation; (4) electrodeposition; and (5) plasma spraying, including detonation gun technology.

While the novel deposition technology of the present invention has some similarities with plasma spraying and detonation gun technologies, it comprises the first embodiment of a new category of deposition technologies. The process of the present invention can be classified as a vapor phase or fine particulate coating technology based on the use of an inductively coupled plasma torch. There is no known prior embodiment of a similar vapor phase or fine particulate deposition process.

Inductively coupled plasma torches have been employed primarily in optical emission spectroscopy. For that purpose, the construction and operation of plasma torches are well developed. See, for example, Fassel and Kniseley (1974), *Anal. Chem.*, 46(13):1110A–11-18A; Fassel (1978), *Science*, 202:183–191; Douglas and Houk (1985), *Prog. Analyt. Atom. Spectrosc.*, 8:1–18; and U.S. Pat. Nos. 3,324,334 and 4,501,965.

Orifice arrangement for molecular beam sampling in spectroscopy applications was analyzed in Pertel (1975), *Intern. J. Mass Spect. and Ion Phys., 16:39–52.* These arrangements involved aligned orifices in the tips of cones. The effect of supersonic velocities on beam scattering is discussed in relation to four conditions illustrated in FIG. 6 (page 49), wherein the molecular beam accelerates to a supersonic velocity after passing through the first orifice. For optimized beam sampling with minimum scattering, Pertel recommends having the Mach disk in effect attached to the orifice tip of the second cone. A somewhat related arrangement is described in Douglas U.S. Pat. No. 4,501,965 for a spectrographic mass analyzer.

The use of a plasma torch for growing refractory crystals by a melting/solidification technique has been described by T. B. Reed (1961), *J. Appl. Phys.*, 32:2534–2535. Particles of the refractory material are carried by a monatomic gas through the center of an inductively coupled toroidal plasma. The material is melted by plasma heating, and deposited from the liquid phase on the growing crystal. A similar method and apparatus is described in Reed's U.S. Pat. No. 3,324,334.

More recently an inductively coupled plasma system operating at reduced pressure has been proposed for the production of silicon carbide powder: Hollabaugh et al. (1983), *J. Materials Sci.*, 18:3190–3194. The silicon carbide is formed by gas phase chemical reaction by injection of silane, methane, and hydrogen into the plasma flame, the siiicon carbide being recovered as a powder.

Arc-type plasma torches have been proposed for use in coating processes. See U.S. Pat. Nos.: Matvay, 3,324,114; Muehlberger, 3,839,618; and Guyonnet, 4,146,654. Arc torches may be provided with multiple orifices (Giannini et al. U.S. Pat. No. 2,922,869 and Guyonnet U.S. Pat. No. 4,146,654). Arc-type torches utilize electrodes between which the arc is struck for generating the plasma. These electrodes may be a source of contamination in the plasma flame. Some arc torches use consumable wire as electrodes. These wires can melt at different rates and/or form large droplets of molten material. Further, the powder is introduced into the plasma and the material interacts directly with the plasma flame and surrounding environment.

As illustrated by the cited Muehlberger patent, if the target to be coated is located within a vacuum chamber, the arc-type torch is inserted into the vacuum chamber. This is a virtual necessity because in arc-type plasma torches the material to be deposited is principally on the surface of the arc. Therefore, unless the arc torch is inserted into the vacuum chamber, only a small quantity of the material can be drawn into the deposition chamber. However, such insertion of the torch into the vacuum chamber will result in a lowering of the plasma temperature. This precludes the use of very high plasma temperatures where the plasma must be operated at or near atmospheric pressure.

SUMMARY OF INVENTION

The process of the present invention utilizes an inductively coupled toroidal plasma. Neither non-toroidal plasmas nor electric arc-generated plasma are suitable. Through the central region of the inductively coupled toroidal plasma, there is passed a stream of gas, preferably a monatomic gas, carrying the finely-divided particulate solids comprising the coating material. The particles of coating material are vaporized by plasma heating as the stream passes through the annulus. The particulate stream is, in effect, enclosed and protected against contamination by the gas annulus. After vaporization, it is directed through a first orifice which separates the atmospheric pressure zone of the plasma from the first vacuum zone in which the pressure is maintained below 50 Torr. The size of the orifice and the pressure in the first vacuum zone are related so that the gas stream bearing the vaporized coating material accelerates to a velocity greater than the speed of sound (above Mach 1). This generates a shock wave along a front downstream from the first orifice. Use of velocities greater than the speed of sound with the generation of the resultant shock wave front are important features of the process of the present invention.

There is also provided a second orifice of larger size than the first orifice in alignment therewith. The second orifice separates the first vacuum zone from the second vacuum zone which is maintained at a lower pressure. The second orifice is positioned in relation to the first orifice so that the shock wave front generated in the first vacuum zone is established at a distance from the first orifice which is slightly greater than the distance between the two orifices, that is, the second orifice is located closer to the first orifice than the shock wave front in the first zone. Because of the reduced pressure maintained in the first zone, the shock wave front can be held at a relatively stable location. By providing the second orifice in the tip of a skimmer cone which intercepts the shock wave, the shock wave can exhaust outwardly through a passage connected to a vacuum pump. With this arrangement, the shock wave front will have little tendency to shift backwardly toward the first orifice. Further, the shock wave, in effect, provides a "dynamic seal" between the first zone and the passage to the vacuum pump. This protects the coating stream from contamination.

The gas stream bearing the coating material passes through the second orifice into the second vacuum zone of higher vacuum within which the target substrate is supported. The coating material-containing stream impinges directly on the surface to be coated. The high vacuum of the second zone minimizes the possibility of contamination. Thin ultra-pure, homogeneous coatings can be formed.

Subsequent to vaporization in the plasma zone, the coating material is cooled below its melting temperature as it passes through the first and second vacuum zones. It deposits in a solidified atomic, ionic and/or molecular form on the target substrate. As the stream of gas bearing the vaporized coating material passes through the first orifice, the gas stream undergoes rapid expansion into an essentially collision-free zone, thereby inducing a high rate of vibrational and rotational cooling which may approach $10^4$ to $10^6$ Kelvin per second. The vaporized material moves through the second orifice with the gas stream and impinges on the surface to be coated. The vaporized material formed in the plasma zone may comprise free atoms, ions, molecules, or molecular clusters, or a mixture of these species. Ultrafine particulates may also travel through the second orifice and impinge on the surface to be coated. The thermal pinch of the gas stream as it enters the first orifice can cause association of atoms to molecules and/or molecules to clusters. This thermal pinch can also be utilized to promote chemical reactions with the coating material.

The plasma coating process of this invention can be utilized to produce unusual and difficult coatings of a high degree of purity and homogeneity. The high temperatures experienced by the materials while passing through the plasma make the system especially suitable for handling refractory materials. Metals and other materials can be atomized and reacted with added reagents to form the coating material. By controlling reaction conditions, both stoichiometric and non-stoichiometric compounds can be produced and utilized for coatings. The process can be used in high technology applications, such as superconductors, dielectrics, semiconductors, optical coatings, and friction reducing surfaces. Also, a variety of organic compounds can be passed through the plasma without appreciable decomposition and employed as coating materials. Organometallic compounds may be formed and deposited.

Summarizing, the process of this invention is believed to be unique in combining a atmospheric pressure inductively-coupled plasma with a low pressure deposition chamber. The coating stream is formed at high temperatures while being shielded against contamination. Gas, which is preferably an inert gas, can surround the particulate stream and protect it against contamination from the surrounding atmosphere as it is directed toward and through the first orifice. The excess gas can flash off on the outside of the first orifice while the particulate stream passes therethrough. In the first vacuum zone, the dynamic seal provided by the shock wave front also protects against contamination. Further, after passing through the second orifice, the stream impinges on the target substrate under conditions of high vacuum, which maintain the effective purity of the stream. The overall results of this combination of steps is that thin, ultrapure coatings can be formed under controlled and reproducible conditions.

THE DRAWINGS

The process of the present invention and the apparatus used therewith are illustrated in the accompanying drawings, in which.

FIG..4 is an enlarged view of the first orifice; and

Figure 5:
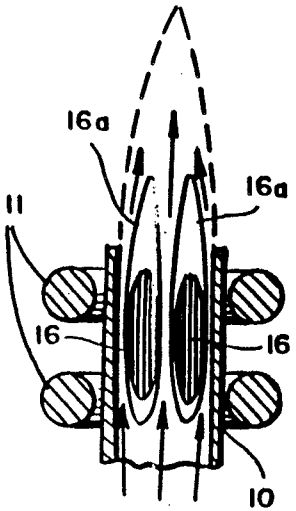

FIG. 5 is a diagrammatic view of the induction coil and toroidal plasma used in the process.

DETAILED DESCRIPTION

Figure 1:
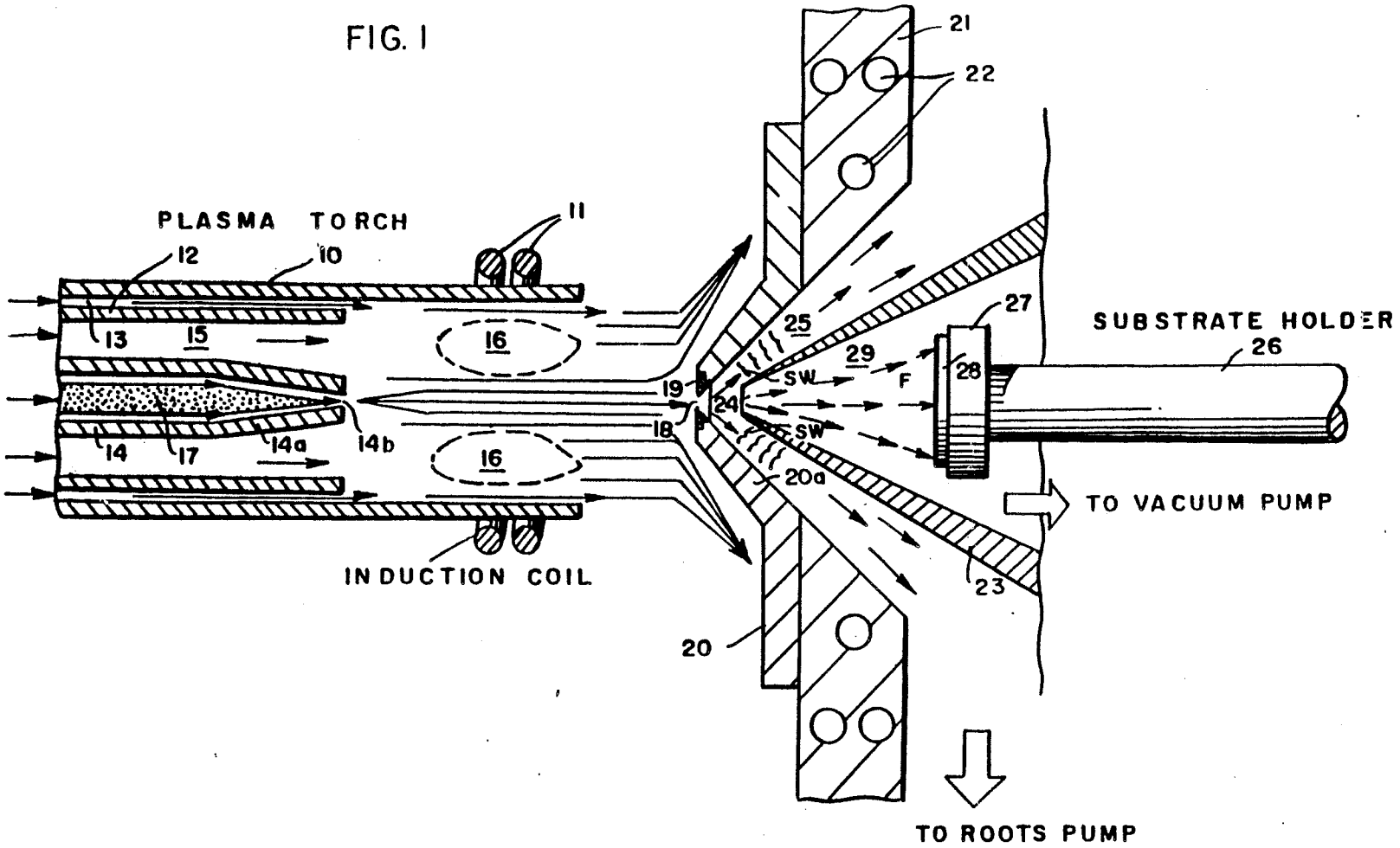
FIG. 1 is a diagrammatic cross-sectional view of a plasma coating apparatus adapted for practicing the process.

Looking first at FIG. 1, the process of this invention and an apparatus for practicing it are illustrated. The apparatus includes an inductively-coupled plasma torch of known construction. The torch includes an outer tube 10 which extends through the plasma induction coil 11. A second tube 12 is mounted centrally within tube 10 to provide an annular passage 13 therebetween, the inner end of tube 12 terminating short of the plasma provided by coil 11. A smaller diameter feed tube 14 is mounted centrally within tube 12, terminating in an outlet **14*b*. Between tubes 12 and 14 there is provided an annular passage 15 through which an auxiliary gas may be supplied to the plasma zone to control the vertical position of the plasma. A toroidal plasma, indicated diagrammatically at 16, is maintained through inductive coupling to a radio frequency applied to the induction coil 11. A stream of gas is supplied through passage 13 which sustains the plasma and also functions as a cooling stream, providing a flow separation of the toroidal plasma from the tube 10**.

The finely-divided solid to be used as a coating material is suspended in the carrier stream of the gas and supplied to the passage 17 within the tube 14. The tube 14 and the outlet **14*b*** are arranged to discharge the coating material-carrying gas stream into and through the relatively plasma-free central region of the toroidal plasma. The respective stream flows are indicated by the arrows applied in FIG. 1. The gas is preferably argon or another monatomic gas, but other gases can be used, such as nitrogen, hydrogen or oxygen.

As the stream of material passes through the plasma zone, the solid particles are converted to a vapor by the high temperature of the surrounding plasma, which may be of the order of 6,000 to 15,000K, since the plasma generating zone is essentially at atmospheric pressure. The induction coil 11 is connected to a radio frequency generator (not shown). For example, a generator of 1 to 15 kilowatt capacity producing frequencies of 20 to 50 megahertz can be employed to generate the high temperature toroidal plasma. In the experimental work leading to the present invention, a 10 kw, 41 MHz generator was employed.

The stream of inert gas containing the vaporized coating material is directed toward a first orifice 18. Orifice 18 is provided by a plug 19 which is removably mounted within the central conical section 20*a* of faceplate 20. Plate 20 is mounted on a backing plate 21 which is provided internally with cooling passages 22 through which cooling fluid can be circulated to prevent overheating of the faceplate and orifice plug. A conical skimmer 23 centrally provides a second orifice 24 aligned with orifice 18. A passage 25 is provided between skimmer 23 and the inner walls of plates 20 and 21. The space between the orifice 18 and the orifice 24 together with the passage 25 provides the first vacuum zone which is connected to a suitable vacuum pump such as a Roots pump. A second vacuum zone 29 is provided within skimmer 23. Zone 29 functions as the coating zone, and includes means for supporting the target substrate. For example, there is provided a substrate holder, including a supporting shaft 26 connected to an enlarged head 27 on which a target substrate 28 can be mounted in alignment with the orifices 18 and 24.

Figures 2, 2A:
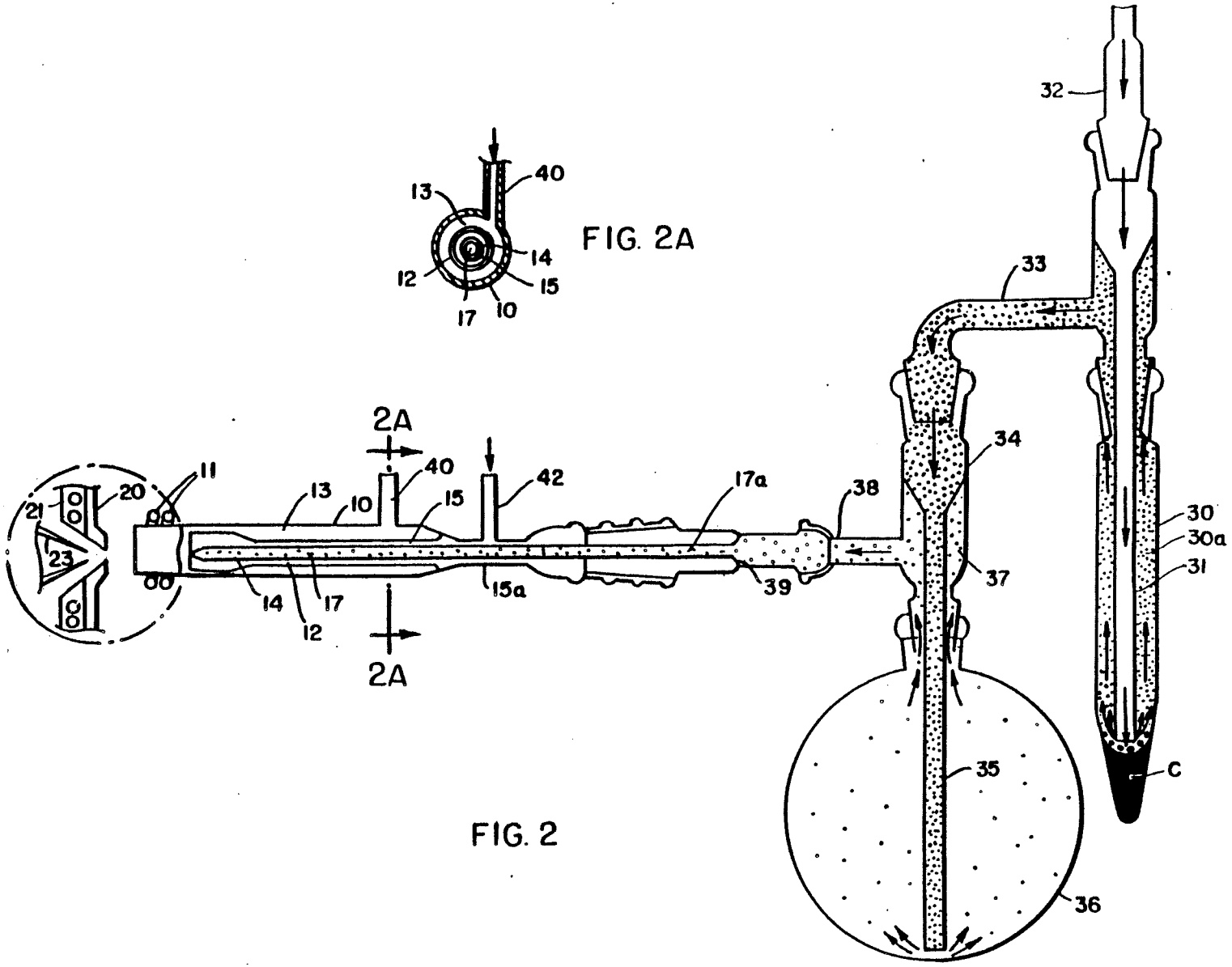
FIG. 2 is a diagrammatic cross-sectional view showing a particle delivery apparatus for use with the apparatus and process of FIG. 1.
FIG. 2A is a detailed sectional view taken on line 2A—2A of FIG. 2 showing the cooling and plasma sustaining gas inlet.

FIG. 2 illustrates the manner in which the gas streams may be supplied, respectively, to the outer torch cooling and plasma sustaining passage 13, the auxiliary plasma supply passage 15, and the inner coating material passage 17. Corresponding elements have been given the same numbers. As one type of pneumatic supply means, the particulate solid coating material C may be placed in the tapered lower end portion of a tube 30 having an interior tube 31 terminating below the material C, as shown. The stream of gas being used (e.g., argon) is supplied through an inlet assembly 32 to tube 31, being discharged from the lower end of the tube over the surface of the particulate material C. As the gas stream sweeps over the coating material, it picks up particles thereof which are borne by the stream upwardly to the annular space 30*a* between tubes 30 and 31, and then into a laterally extending tube 33, which communicates through a connector assembly 34 to tubular extension 35. The extension 35 reaches to a position near the bottom of flask 36. As the particle-bearing gas stream is discharged from the lower end of tube extension 35 it reverses direction and fans out within the interior of flask 36. The resulting reduction in gas velocity permits the coarser particles to settle out, while the finer particles of more uniform size are carried into the annular outlet 37 provided within assembly 34. Outlet passage 37 communicates with a laterally extending tubular extension 38 which connects through entry section 39 to the interior of an extension 17*a* of passage 17. Particle-bearing gas stream then flows through passage 17, which discharges into the central region of the toroidal plasma.

Inlets are also provided for the other streams of gas. Preferably the same gas, usually argon (but other gases may be used) is supplied to the outer torch cooling and plasma sustaining passage 13 through an inlet 40. Inlet 40 is arranged tangentially with respect to tube 10 so that the gas flows in a generally spiral pattern as it moves forwardly in passage 13 to provide the cooling flow between the outer boundary of the plasma and the inner wall of tube 10. Another entry for gas is provided through inlet 42 which communicates with an extension 15*a* of passage 15.

Conventional materials of construction may be used for the apparatus components described above. For example, the tubes 10, 12, and 14 may be formed of quartz, plate 20 and orifice plug 19 of nickel, plate 21 of copper, skimmer 23 and substrate holder 26 of stainless steel. The induction coil may be formed of copper.

In carrying out the method of this invention, the sizes of orifices 18 and 24 are important. Orifice 24 is larger than orifice 18. For example, the first orifice 18 may have a diameter in the range from about 0.125 to 2.4 millimeters, while the second orifice 24 may have a diameter of 0.25 millimeters or greater up to as large as 10 millimeters. The presently preferred size for the second orifice is in the range from about 1.4 to 2.7 millimeters when used with a first orifice size of from 1.1 to 1.3 millimeters. Orifice 24 may be of fixed diameter, but it is preferable to provide the orifice 18 in a removable plug so that the size of the first orifice can be selectively varied. For example, plug 19 may be inserted with a press fit so that it can be removed.

The pressure conditions for the zones 25 and 29 are also of importance. The pressure in the first zone 25 should be maintained below 50 Torr and preferably below 20 Torr. For example, the pressure in the first zone 25 may be in the range of 0.1 to 10 Torr. A high differential pressure will be obtained across the orifice 18, viz. from atmospheric pressure in the plasma zone to a pressure of 0.1 to 50 Torr within the zone 25. The pressure maintained in the second vacuum zone 29 should be substantially lower than in zone 25. In general, the pressure in zone 29 should be below $10^{-2}$ Torr and preferably below $10^{-4}$ Torr. For example, operating conditions in zone 29 may range from $10^{-4}$ to $10^{-5}$ Torr.

Suitable vacuum pump connections are provided, respectively, to the passages connecting to zones 25 and 29. For example, a Roots pump may be used to provide the vacuum within zone 25. A diffusion-type vacuum pump may be used to produce the lower pressure within zone 29.

OPERATION OF PROCESS

In operating the process, the zone surrounding the plasma torch can be at essentially atmospheric pressure, being a zone communicating with the surrounding atmosphere. If desired, an enclosure may be provided around the plasma torch, and the interior of the enclosure connected to a suitable exhaust fan for removing excess gas discharged from the plasma zone against face plate 20. The diversion of such excess gas is indicated by arrows in FIG. 1.

In starting up the apparatus, a gas flow is introduced into the cooling passage 13. An appropriate radio frequency is applied to the induction coil, and the ionization of the gas in the area of the induction coil is induced by any one of a number of known means. For example, a discharge from a Tesla coil may be directed at the base of tube 10 and the ions thus formed flow into the region surrounded by the induction coil, thereby forming the plasma. The Tesla coil discharge is then discontinued.

Once the plasma has been formed and stabilized, the flow of the coating material-bearing gas is started. If an auxiliary gas is going to be used, its flow to passage 15 is initiated. The pneumatic transport system is used, as previously described with reference to FIG. 2. The particles of solid material should be very finely divided. In general, it is preferred to provide particles of average size of less than 50 microns. For example, the particles may have an average size of from about 1 to 25 microns, but submicron particles can also be employed. A wide range of particle sizes can be used providing the particles can be carried in a relatively uniform suspension by the gas stream applied to passage 17.

The size and temperature of the toroidal plasma may be controlled by the energy supplied by the induction coil. For example, plasma temperatures of from about 6000 to 15,000 Kelvin can be obtained.

The size of the first orifice 18 and the pressure in the first zone 25 should be related so that the particle bearing stream accelerates to a velocity greater than the speed of sound on emerging from orifice 18 into zone 25. Due to this rapid acceleration to velocities greater than Mach 1, a shock wave will be generated along a front downstream of the orifice 18. In FIG. 1, the beginning of the shock wave (SW) is indicated as starting in the approximate position where it should be located. More specifically, the second orifice 24 in the tip of skimmer cone 23 is located a little closer to orifice 18 than the shock wave front. The tip of cone 23 intercepts the shock wave front, and preferably pierces the shock wave front. With this arrangement, the shock wave effectively occupies the space between the orifices without interfering with the entry of the particle-bearing stream into zone 29 through orifice 24. Accelerations within zone 25 to velocities greater than Mach 1 can be obtained. Given the desired distance to the shock wave front, the required size of orifice 18 may be determined by a calculation using the pressure drop across the orifice as one of the parameters.

The mathematical formula which may be used is described in Ashkenas, H.; Sherman, F. S., "Rarefield Gas Dynamics, Proc. 4th Ing. Symp. Rarefield Gas Dynamics"; de Leeuw, J. H., Ed.; Academic Press: New York, 1966, Vol. II, p. 84. Ashkenas and Sherman have shown that the Mach disk forms at a distance $X_M$ from the orifice given by:

$$X_M = 0.67\, D_o \left(\frac{P_o}{P_1}\right)^{1/2}$$

where $X_M$ is the distance downstream from the orifice (18) to the plane of the Mach disk $D_o$ is the orifice (18) diameter $P_o$ is the inductively coupled plasma pressure $P_1$ is the pressure in the region downstream of the orifice (18).

Typical calculation:

$$X_M = 0.67\, D_o \left(\frac{P_o}{P_1}\right)^{1/2}$$

$$X_M = 0.67(1.27\text{ mm}) \left(\frac{760\text{ Torr}}{0.600\text{ Torr}}\right)^{1/2}$$

$$X_M = 30.3\text{ mm}$$

Using the foregoing formula, representative orifice size, pressure drops and shock wave front distances are calculated, as tabulated below.

Mach Disk Calculations

| $D_o$(mm) | $P_o$(Torr) | $P_1$(Torr) | $(P_o/P_1)^{\frac{1}{2}}$ | $X_M$(mm) |
|---|---|---|---|---|
| 1.27 | 760 | 1.40 | 23.3 | 19.8 |
| ↓ | ↓ | 1.34 | 23.8 | 20.3 |
| ↓ | ↓ | 1.27 | 24.5 | 20.8 |
| ↓ | ↓ | 1.18 | 25.4 | 21.6 |
| ↓ | ↓ | 0.782 | 31.2 | 26.5 |
| ↓ | ↓ | 0.737 | 32.1 | 27.3 |
| ↓ | ↓ | 0.683 | 33.4 | 28.4 |
| ↓ | ↓ | 0.651 | 34.2 | 29.1 |
| ↓ | ↓ | 0.600 | 35.6 | 30.3 |
| 1.27 | 760 | 0.544 | 37.4 | 31.8 |

Figure 3:
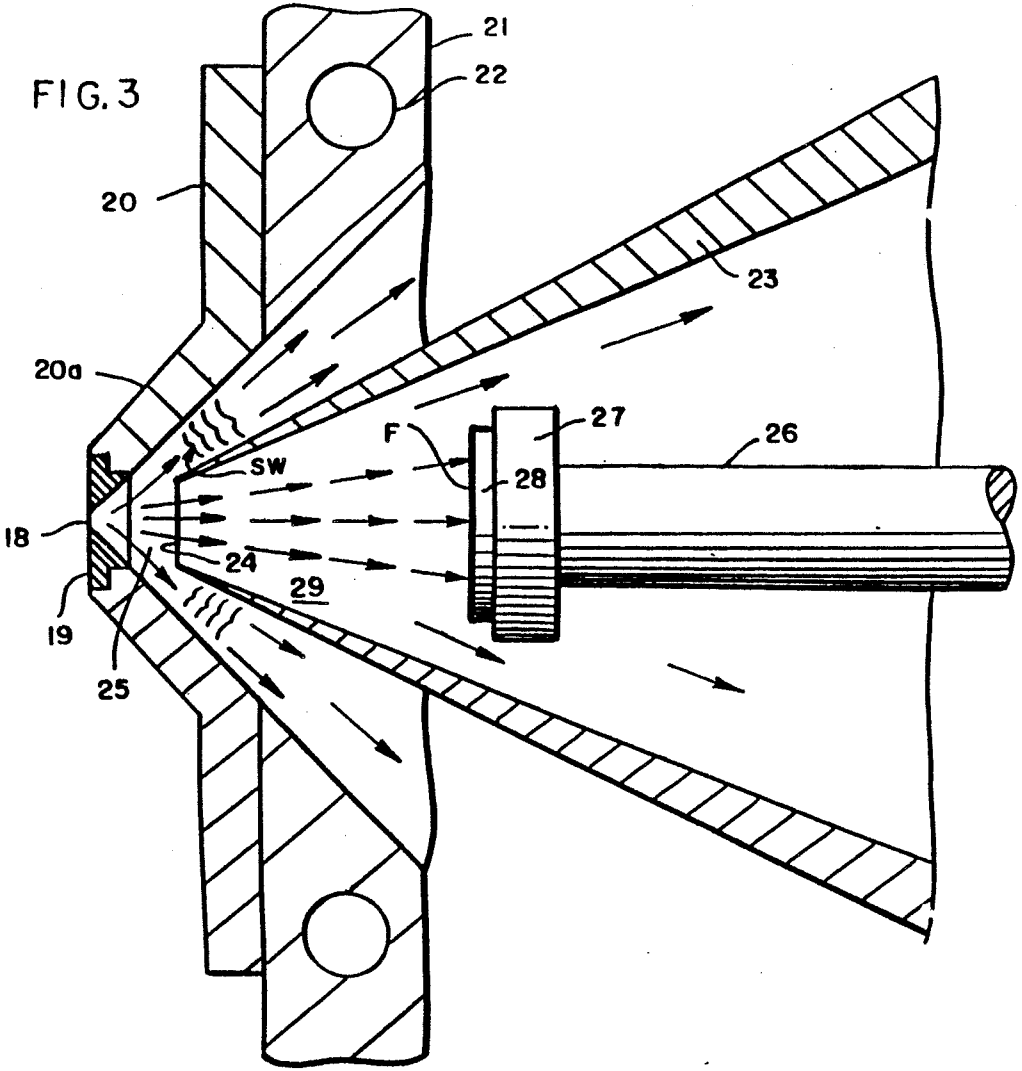
FIG. 3 is an enlarged section view of a portion of the apparatus, showing the orifices, vacuum chambers, and substrate holder.

The coating process may be further visualized by referring to the enlarged view of FIG. 3. The target substrate 28 is mounted on the face of the holder head 27 in alignment with the orifices 18 and 24. The pressure drop across orifice 18 and the resulting rapid acceleration and expansion of the particle carrying gas stream causes extremely rapid vibration and rotational cooling of the vapor state material. This cooling continues as the stream passes through the orifice 24 into the second vacuum zone 29. The stream carrying the coating constituents impinges on the surface of the target substrate 28, forming a solid film coating F thereon, as indicated in both FIGS. 1 and 3. Film thicknesses of up to 100 micrometers or thicker may be obtained. For example, coatings measuring 1 to 100 micrometers have been produced. The coating material can interact with and adhere securely to the substrate.

Auxiliary equipment may include an optical spectrometer, a residual gas analyzer and a manipulator for moving and positioning the substrate. The optical spectrometer can monitor the coating species being deposited, the coating material being observed in the free-jet expansion region between orifice 18 and the target substrate. The residual gas analyzer can monitor the gas surrounding the substrate during processing, thereby determining to what extent extraneous gaseous species are present. The lower the pressure within zone 29, the less extraneous species present and the purer the coating produced will be.

Figure 4:
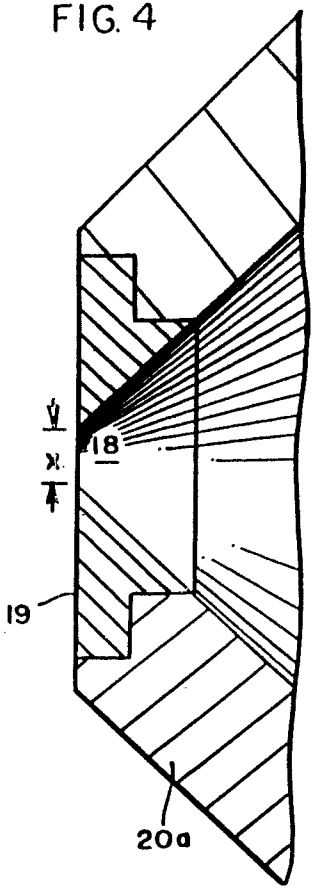

The removable orifice plug 19 is shown more clearly in FIG. 4. As shown, orifice 18 is of circular cross-section, enlarging conically from the entry dimension "x", which is the critical diameter. This diameter may be varied by changing the orifice plug. The conical enlargement of the orifice passage tends to prevent deposition of solids on the inside of the orifice. If this occurs the orifice plug can be removed and cleaned or replaced. As shown, the conical wall of the orifice merges smoothly with the inner wall of the conical plate section 20*a*.

Target substrate within zone 29 should be spaced a sufficient distance from orifice 18 to achieve a relatively uniform coating. For example, an orifice to target distance of from 3 to 15 centimeters can be employed. The impingement area of the target may range from 0.03 to 15 centimeters in diameter.

FIG. 5 illustrates the toroidal plasma. The annular configuration of the hottest portion of plasma 16 is indicated by the dark shading. The ionized gas of the plasma may extend both rearwardly and forwardly along the direction of flow, achieving a flamelike shape at its forward portion 16*a*, as indicated. As previously described, the gas flow around the outside of the plasma annulus protects the quartz tube 10 from the highest temperatures of the plasma. The particle bearing stream passes through the relatively plasma-free central portion of the annulus. The streams merge on the downstream side into a generally flame-shaped extension as indicated by the dotted outline. It should be understood, however, that this diagrammatic illustration cannot exactly represent the operative conditions of the plasma. A computer simulation is described in Barnes and Schleicher (1975), *Spectrochimica Acta* 30B:109–134.

With a plasma torch design where the tube 10 has an internal diameter of around 1.8 centimeters, a cooling gas flow of argon of 8 to 20 liters per minute may be used. A carrier gas stream flow rate of 0.25 to 5 liters per minute may be used. The auxiliary gas flow is directed toward the plasma annulus 16 and supplied through passage 15 may range from 0 to about 3.0 liters per minute.

The process of this invention is further illustrated by the following experimental examples.

EXAMPLE I

The operating conditions for coating yttria on a stainless steel substrate are as follows: The stainless steel substrate, 1 millimeter thick, was mounted onto substrate holder 27 and attached to substrate positioning shaft 26. The substrate assembly was positioned 35 millimeters from orifice 24 and 48 millimeters from orifice 18. The vacuum pumps pumped the chamber down to a pressure of $4\times10^{-7}$ millimeters mercury. Cooling water was supplied to plate 21 through passage 22. The plasma torch was brought within 15 millimeters of orifice 18. Orifice 18 was then opened to atmosphere. The plasma was established by introducing argon gas into passage 13 at a rate of 18 liters per minute. A Tesla coil discharge was applied to the base of tube 10 to form the ions which flow into the region surrounded by the induction coil, thereby initiating the plasma. The Tesla coil discharge was discontinued.

The plasma was stabilized at 1.8 kilowatts incident power. The argon gas was supplied at a rate of 1 liter per minute to the pneumatic transport system and used to suspend and transport the 2–20 micrometer particles through passage 17. The auxiliary gas flow, passage 15, was not used. Orifice 18 was 1.27 millimeters diameter and orifice 24 was 2.5 millimeters diameter. The pressure in zone 25 averaged 1.27 Torr. The pressure in zone 29 was less than $1\times10^{-3}$ millimeters mercury. The plasma was shut down after 60 minutes deposition time. The coating, substrate and assembly cooled down inside the chamber.

Visual inspection of the coating revealed it to be a dark gray color. An AES surface and depth profile of the coating showed it to be 1–3 micrometers thick and yttrium to oxygen ratios showed the coating to be a suboxide of yttria. X-ray analysis of the coating showed it to be a suboxide of yttria. The substoichiometric structure is thought to be $YO_{1.49}$.

EXAMPLE II

Yttria powder was deposited onto a copper substrate under similar conditions as in Example I. Orifice 24 was reduced to 1.4 mm which reduced the pressure in the first vacuum zone to 0.78 Torr. The coating was dark gray in color. The x-ray analysis showed the coating to be of substoichiometric structure.

EXAMPLE III

Niobium metal powder was introduced into the system under similar conditions as in Example I, again using a stainless steel substrate. The deposition time was halved, only 30 minutes. This produced a metallic (silvery) gray coating. AES surface and depth profiling showed the coating to be a few tenths of a micrometer thick. X-ray analysis showed the coating to be niobium metal.

EXAMPLE IV

Niobium metal powder was deposited onto a copper substrate under exactly the same conditions as Example III. This yielded an almost exact duplicate of the coating in Example III except on a copper substrate instead of a stainless steel substrate.

EXAMPLE V

Niobium metal powder was deposited onto a pure iron substrate. A chromel-alumel thermocouple was attached to the backside of the iron substrate to monitor temperature. During the 30 minute deposition the temperature approached 160° C. Orifice 24 was reduced to 1.4 mm which reduced the pressure in the first vacuum zone to 0.7 Torr. The other operating conditions were similar to Example I. The deposit was uniform, metallic gray in color and x-ray analysis showed the coating to be niobium metal.

EXAMPLE VI

Niobium metal powder was deposited onto a copper substrate under exactly the same conditions as Example V, yielding the same results.

EXAMPLE VII

Alumina powder was deposited onto a pure iron substrate under very similar conditions as Example V. The substrate temperature approached 140° C. during the 30 minute deposition time. The coating was lighter gray in color.

EXAMPLE VIII

Alumina powder was deposited onto a copper substrate under exactly the same conditions as Example VII.

We claim:

1. A process for applying a coating of a normally solid material to a target substrate, comprising:

(a) within a zone at essentially atmospheric pressure generating an inductively coupled toroidal plasma from an inert gas, said generated plasma being in the form of an annulus with a plasma-free central portion;

(b) passing a carrier stream of said gas through the central portion of said plasma annulus;

(c) introducing a finely-divided particulate solid coating material into said carrier gas upstream of said plasma annulus;

(d) vaporizing the particles of said coating material by inductively coupled plasma heating as said stream passes through said plasma annulus;

(e) downstream of said annulus directing said stream containing said vaporized coating material through a first orifice which separates said atmospheric pressure zone from a first-vacuum zone, said first zone having a vacuum maintained therein below 50 Torr, the size of said first orifice and the vacuum in said first zone being related so that said stream accelerates on passing through said first orifice to a velocity greater than Mach 1 within said first zone generating a shock wave along a front downstream of said first orifice, said shock wave providing a Mach disk at a predetermined distance from said first orifice and the vacuum being applied to said first-vacuum zone on the downstream side of said Mach disk;

(f) providing a second orifice of larger size than said first orifice in stream flow alignment therewith, said second orifice being provided in the tip of conical skimmer extending downstream from said first orifice and separating said first vacuum zone from a second vacuum zone within said skimmer which second zone is maintained at a higher vacuum than said first zone, said second orifice being located in relation to said first orifice so that said Mach disk is intercepted by said skimmer means adjacent its orifice-providing tip;

(g) passing at least a portion of the coating material containing stream through said second orifice; and (h) supporting a target substrate within said second zone in alignment with said second orifice so that said stream portion impinges thereon, the coating material in the carrier stream being cooled below its melting temperature as it passes through said first and second vacuum zones and being deposited in solid form on the target substrate.

2. The process of claim 1 in which said plasma and carrier stream gas is argon.

3. The process of claim 1 in which said first vacuum zone is maintained at a pressure below 20 Torr and said second vacuum zone is maintained at pressure below $10^{-2}$ Torr.

4. The process of claim 1 in which said first orifice has a diameter of from 0.125 to 2.5 millimeters and said second orifice has a diameter of from 0.25 to 10 millimeters, said second orifice having a diameter greater than the diameter of said first orifice.

5. The process of claim 1 in which the particulate coating material as introduced into the carrier gas has an average particle diameter of less than 50 microns.

6. The process of claim 1 in which said monatomic gas is argon and said particulate coating material as introduced in the argon carrier stream has an average particle diameter of from 1 to 25 microns.

7. The process for applying a coating of a normally solid material to a target substrate, comprising:

(a) within a zone at essentially atmospheric pressure generating an inductively coupled toroidal plasma from a monatomic gas, said generated plasma being in the form of an annulus with a plasma-free central portion;

(b) passing a carrier stream of said monatomic gas through the central portion of said plasma annulus;

(c) introducing a finely-divided, particulate solid coating material into said carrier gas upstream of said plasma annulus, the particles of said material having an average size of less than 50 microns;

(d) vaporizing the particles of said coating material by inductively coupled plasma heating as said stream passes through said plasma annulus;

(e) downstream of said annulus directing said stream containing said vaporized coating material through a first orifice which separates said atmospheric pressure zone from a first-vacuum zone, said orifice being of circular shape and having a diameter of from 0.125 to 2.5 millimeters, said first vacuum zone having a pressure maintained therein below 20 Torr, the diameter of said first orifice and the vacuum in said first zone being related so that said stream accelerates on passing through said first orifice to a velocity greater than Mach 1 within said first zone generating a shock wave along a front downstream of said first orifice, said shock wave providing a Mach disk at a predetermined distance from said first orifice and the vacuum being applied to said first-vacuum zone on the downstream side of said Mach disk;

(f) providing a second circular orifice having a diameter greater than the diameter of said first orifice in stream flow alignment therewith, said second orifice being provided in the tip of conical skimmer means extending downstream from said first orifice and separating said first vacuum zone from a second vacuum zone within said skimmer means which is maintained at a pressure below $10^{-4}$ Torr, said second orifice being located in relation to said first orifice so that said Mach disk is pierced by said skimmer means adjacent its orifice-providing tip;

(g) passing at least a portion of the coating material-containing stream through said second orifice; and (h) supporting a target substrate within said second zone in alignment with said second orifice so that said stream portion impinges thereon, the coating material in the carrier stream being cooled below its melting temperature as it passes through said first and second vacuum zones and depositing in solid form on the target substrate.

8. The process of claim 7 in which said monatomic gas is argon.

9. The process of claim 7 in which the particulate coating material introduced into the carrier gas has an average particle diameter of from 1 to 25 microns,.

10. The process of applying a coating of a vaporized normally solid material to a target substrate, comprising:

(a) within a zone at essentially atmospheric pressure generating an inductively coupled toroidal plasma from argon gas, said generated plasma being in the form of an annulus with a plasma-free central portion;

(b) passing a carrier stream of said argon gas through the central portion of said plasma annulus;

(c) introducing a particulate coating material into said carrier gas upstream of said plasma annulus, said particulate coating material having an average particle diameter of from 1 to 25 microns;

(d) vaporizing the particles of said coating material by inductively coupled plasma heating as said stream passes through said plasma annulus;

(e) downstream of said annulus directing said stream containing said vaporized coating material through a first orifice which separates said plasma atmospheric pressure zone from a first-vacuum zone, said orifice being of circular shape and having a diameter of from 1.1 to 1.3 millimeters, said first vacuum zone having a pressure maintained therein below 20 Torr, the diameter of said first orifice and the vacuum in said first zone being related so that said stream accelerates on passing through said first orifice to a velocity greater than Mach 1 within said first zone generating a shock wave along a front downstream of said first orifice, said shock wave providing a Mach disk at a predetermined distance from said first orifice and the vacuum being applied to said first-vacuum zone on the downstream side of said Mach disk;

(f) providing a second orifice of larger diameter than said first orifice in stream flow alignment therewith, said second orifice having a diameter in the range of 1.4 to 2.7 millimeters, said second orifice being provided in the tip of conical skimmer means extending downstream from said first orifice and separating said first vacuum zone from the second vacuum zone within said skimmer means which is maintained at a pressure of below $10^{-4}$ Torr, said second orifice being located so that said Mach disk is pierced by said skimmer means adjacent its orifice-providing tip;

(g) passing at least a portion of the coating material-containing stream through said second orifice; and (h) supporting a target substrate within said second zone in alignment with said second orifice so that said stream portion impinges thereon, the coating material in the carrier stream being cooled below its melting temperature as it passes through said first and second vacuum zones and depositing in solid form on the target substrate.

* * * * *